US005601035A

United States Patent [19]

Herring et al.

[11] Patent Number: 5,601,035

[45] **Date of Patent: *Feb. 11, 1997**

[54] CORRUGATED FIBERBOARD PALLET

[75] Inventors: Morris A. Herring; Morris A. Herring, Jr., both of Tucson, Ariz.

[73] Assignee: Ecological Pallets Limited, Tucson, Ariz.

[ * ] Notice: The term of this patent shall not extend beyond the expiration date of Pat. No. 5,327,839.

[21] Appl. No.: 475,498

[22] Filed: Jun. 7, 1995

Related U.S. Application Data

[60] Division of Ser. No. 274,027, Jul. 12, 1994, which is a continuation-in-part of Ser. No. 885,657, May 19, 1992, Pat. No. 5,327,839, which is a continuation of Ser. No. 797,273, Nov. 25, 1991, Pat. No. Des. 337,406.

[51] Int. Cl.[6] ..... B65D 19/00

[52] U.S. Cl. ..... 108/51.3

[58] Field of Search ..... 108/51.1, 51.3, 108/56

[56] References Cited

U.S. PATENT DOCUMENTS

| | | | |
|---|---|---|---|
| 2,388,730 | 11/1945 | Fallert . | |
| 2,432,295 | 12/1947 | Donahue . | |
| 2,501,506 | 3/1950 | George . | |
| 3,055,624 | 9/1962 | Wilson . | |
| 3,464,371 | 9/1969 | Gifford . | |
| 3,557,719 | 1/1971 | Gielas | 108/56 |
| 4,424,753 | 1/1984 | Eatherton | 108/51.1 |
| 4,454,946 | 6/1984 | Yokowo | 206/600 |
| 5,076,176 | 12/1991 | Clasen | 108/51.3 |
| 5,129,329 | 7/1992 | Clasen | 108/51.3 |
| 5,327,839 | 7/1994 | Herring et al. | 108/51.3 |

FOREIGN PATENT DOCUMENTS

| | | |
|---|---|---|
| 0450393 | 8/1948 | Canada . |

*Primary Examiner*—Peter M. Cuomo
*Assistant Examiner*—Gerslo A. Anderson
*Attorney, Agent, or Firm*—Fitzpatrick, Cella, Harper & Scinto

[57] ABSTRACT

A corrugated fiberboard pallet includes a multiple-ply corrugated fiberboard top member, a plurality of multiple-ply corrugated fiberboard runners, a plurality of multiple-ply corrugated fiberboard supports and a plurality of longitudinally extending multiple-ply corrugated fiberboard rails. The top member has corrugations extending in a first direction. The upper surface of each of the runners is affixed to the lower surface of the top member and corrugations of each of which extend in one of the first direction and a direction transverse to the first direction. The upper surface of each of the supports is affixed to the lower surface of respective ones of the runners. The corrugations of each of the supports and rails also extend in one of the first direction and the direction transverse to the first direction. The rails each have an upper surface and a lower surface with the upper surface of each of which being affixed to a respective grouping of the supports. In another embodiment, the supports are eliminated such that the pallet includes a multiple-ply corrugated fiberboard top member, and a plurality of multiple-ply corrugated fiberboard supports and rails affixed together.

11 Claims, 6 Drawing Sheets

CORRUGATED FIBERBOARD PALLET

This application is a divisional of Ser. No. 08/274,027 filed Jul. 12, 1994, which application is still pending and a continuation-in-part of prior application Ser. No. 07/885,657 filed May 19, 1992, now U.S. Pat. No. 5,327,839, which application is a continuation of prior application Ser. No. 07/797,273 filed Nov. 25, 1991, now Des. U.S. Pat. No. 337,406.

BACKGROUND OF THE INVENTION

1. Field of Invention

This invention generally relates to pallets and other devices used for goods and material handling, supporting, transporting and the like. More specifically, this invention relates to corrugated fiberboard pallets that are lightweight, inexpensive to manufacture, readily disposable, easy to recycle and able to be made water resistant.

2. Description of the Related Art

For many years, pallets have been used for the handling, supporting and transporting, for example, of goods and material. Traditionally, such pallets have been made from wood. Wooden pallets have wooden runners upon which boards are nailed or stapled to produce a deck on which goods are stacked or otherwise placed. The wooden runners elevate the deck above a floor or other supporting surface. This enables the tines of a forklift truck or other transport device to be inserted beneath the deck. Sometimes, the runners are notched to provide four-way entry of a forklift or a pallet jack.

With the ever-increasing cost of lumber, wooden pallets have become expensive. The estimated dollar volume of new pallets produced in the United States in 1991, alone, was $4.4 billion for approximately 541 million new pallets produced. In order to justify their cost, wooden pallets must be used over and over again.

Recent ecological efforts have placed an emphasis on reducing consumption of raw lumber. Such efforts also have placed an emphasis on the ability to recycle any products originally made from wood or lumber, for instance, as the raw material. However, due to their construction of heavy wood and nails, traditional wooden pallets are not readily recyclable and/or biodegradable.

Recent estimates show that of the pallets produced in the United States in 1991, sixty percent were of the warehouse or returnable variety, while forty percent were of the expendable or single use variety. Accordingly, approximately 216 million of the wooden pallets produced in 1991 were shipped only one-way within the United States or overseas. It is estimated that 50 million pallets are shipped out of the country, one-way, each year.

Wooden pallets themselves are also heavy, so that even a load of unloaded wooden pallets is not easily transported or handled. Rather, the weight of such pallets limits the number which may be stacked by a forklift or transported by a pallet jack. These limitations increase the floor space required for storage, which, in warehouses, is very expensive. Such expenses are passed on to the end user or consumer. Heavy wooden pallets also are limited in the amount of weight they may carry. Such payload weight should be limited by the products being carried, rather than by the carrying device.

A few pallet manufacturers have substituted less expensive or lighter weight materials either in whole or in part for wood, and have produced pallets which by reason of their cost may be used more readily on a disposable or one-trip basis. For example, decks made of corrugated paperboard have been substituted for the traditional boards. Also, runners formed from plastics or foam in a honeycomb configuration have taken the place of traditional wooden runners. Pallets so made cost considerably less than the traditional wooden pallets. Moreover, such pallets are considerably lighter than wooden pallets, and thus, are much easier to handle.

Even though paperboard pallets of the foregoing construction have advantages over traditional wooden pallets, they may not possess the strength of wooden pallets, either in compression or in shear. In this regard, a pallet that utilizes plastic or foam for its supporting legs may collapse if shifted laterally over a floor while the runners are in contact with the floor. This sometimes occurs when forklift operators try to manipulate the pallets laterally over a floor. This is known as side-shifting.

Other attempts have been made to manufacture pallets entirely of corrugated cardboard. However, to date, such pallets have had limited strength, since manufacturers have compromised strength for reduction in weight. Weight of cardboard pallets can be reduced by using elements of minimal thickness, such as those made of a single layer of corrugated cardboard. However, such a decrease in weight also significantly decreases structural integrity. This is disadvantageous.

Accordingly, a need has arisen for a corrugated fiberboard pallet that is lightweight and constructed from an inexpensive and recyclable material, yet possesses substantial strength, approaching or exceeding that of traditional wooden pallets.

SUMMARY OF THE INVENTION

An object of the present invention is to provide a corrugated fiberboard pallet that is lightweight and is made from relatively inexpensive material, yet is strong and is capable of supporting heavy loads.

Another object is to provide such a corrugated fiberboard pallet that is inexpensive and can be used on a disposable one-trip basis, yet is durable enough to be used on more than one occasion, so that it can be recycled.

An additional object is to provide a corrugated fiberboard pallet that is completely biodegradable and may be disposed of (if not recycled) in a regular landfill.

Yet another object is to provide a pallet of the type stated that can withstand so-called side-shifting, and one that is very strong in both compression and shear, for example.

Still another object is to provide a pallet of the type stated that provides adequate four-way entry of a fork-lift, pallet jack or other transport device.

These and other objects and advantages will become apparent hereinafter.

In achieving these objects, the present invention provides a corrugated fiberboard pallet, comprising: a multiple-ply, corrugated fiberboard top member having a uniform upper surface and a lower surface, corrugations of the multiple-ply top member extending in a first direction; a plurality of multiple-ply corrugated fiberboard runners, each having an upper surface and a lower surface, the upper surface of each of which being affixed to the lower surface of the top member and corrugations of each of which extending in one of the first direction and a direction transverse to the first direction; a plurality of multiple-ply, corrugated fiberboard supports, each having an upper surface and a lower planar surface, the upper surface of each of which being affixed to the lower surface of a respective one of the runners and corrugations of each of which extending in one of the first direction and a direction transverse to the first direction; and a plurality of multiple-ply corrugated fiberboard rails each having a planar surface and a lower surface, the upper surface of each of which being affixed to a respective grouping of the supports and corrugations of each of which extending in one of the first direction and the direction transverse to the first direction.

The present invention also provides a corrugated fiberboard pallet, comprising a multiple-ply, corrugated fiberboard top member having a uniform upper surface and a lower surface, corrugations of the multiple-ply top member extending in a first direction; a plurality of multiple-ply corrugated fiberboard runners, each having an upper surface and a lower surface, the upper surface of each of which being affixed to the lower surface of the top member and corrugations of each of which extending in one of the first direction and a direction transverse to the first direction; and a plurality of multiple-ply corrugated fiberboard rails each having an upper surface and a lower surface, the upper surface of each of which being affixed to respective ones of the runners and corrugations of which extending in one of the first direction and the direction transverse to the first direction.

The foregoing objects of the present invention, together with various other objects and advantages thereof which will become evident hereinafter, may be obtained by the exemplary embodiments illustrated in the accompanying drawings, which will now be described in detail.

BRIEF DESCRIPTION OF DRAWINGS

Like members have been used for like elements throughout the Figures.

DETAILED DESCRIPTION OF THE PREFERRED EMBODIMENTS

Figure 1:
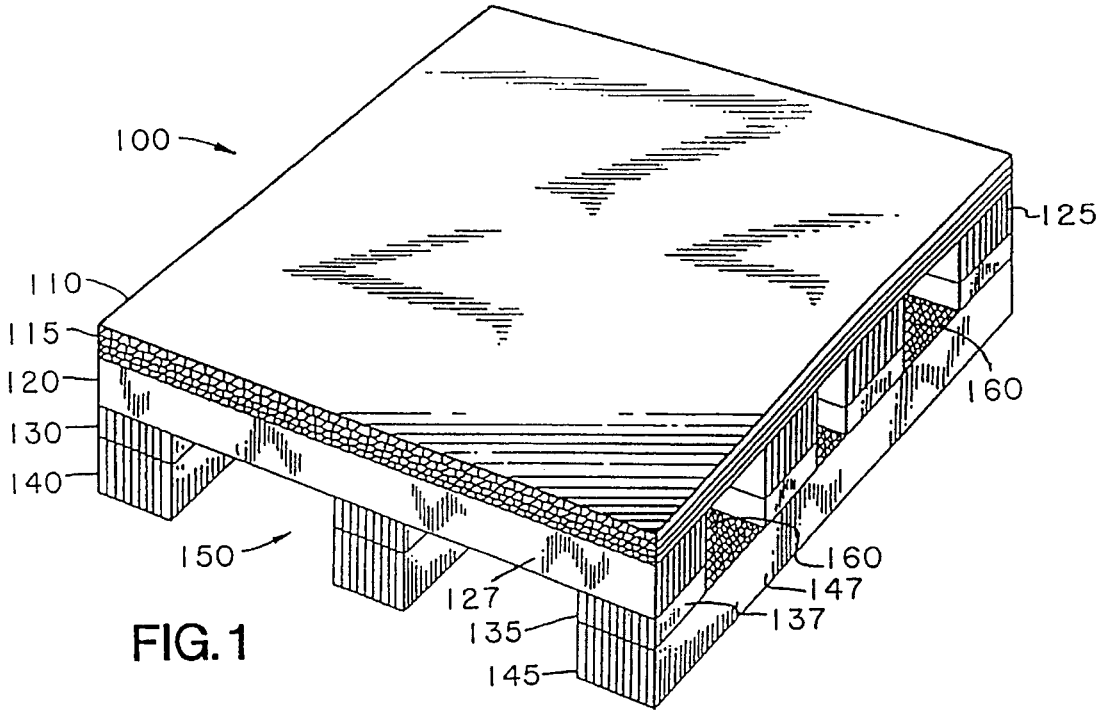
FIG. 1 is a perspective view of a first embodiment of a corrupted fiberboard pallet of the present invention.

Specific descriptions of the preferred embodiments of the corrugated fiberboard pallet according to the present invention are given below, referring to the drawings, which are intended to be illustrative only.

Reference numeral 100 in FIG. 1 generally indicates a corrugated fiberboard pallet constructed in accordance with the present invention. As used herein, the term "fiberboard" refers to and includes corrugated fiberboard, cardboard, chipboard, paperboard and like paper products that are relatively stiff and capable of withstanding substantial loads when manufactured to produce the pallet of the present invention. The fiberboard may also be derived from recycled materials including cardboard, paper, rags, sawdust and the like. Manufacturing using the materials discussed above renders the pallet of this invention readily recyclable and/or biodegradable.

Further, such a pallet is inexpensive to manufacture using standard techniques.

The corrugated fiberboard pallet 100 includes a multiple-ply corrugated fiberboard top member 110 which constitutes a deck or surface for supporting goods or materials. Top member 110, which may, for instance, be square or rectangular in shape, may be constructed of flute corrugated fiberboard, cardboard or paperboard, as will be discussed below. A typical pallet 100 having top member 110 may be on the order of 40"×40" to 40"×48" to 59¼"×44¾" with other sizes available. For example, a conventional size for European distribution might be 800 mm×1200 mm.

Pallet 100 may be less than 3" in height and weigh between ten and twenty pounds. Regardless of the size required by the consumer, the configuration of the pallet 100 generally remains the same. When multiple-ply corrugated fiberboard forms the top member 110, it is desirable to have corrugations 115 extending in the same direction, with flat layers of fiberboard separating the corrugated layers. These flat layers may also form the top and bottom layers of top member 110. It is desirable to have the top member 110 be continuous, that is, without voids or openings. Thus, top member 110 has an upper planar surface and a lower planar surface with corrugations of the multiple-ply member extending in a first direction. If necessary, however, top member 110 can have voids, openings or serrations for venting or draining purposes.

For top member 110, it is preferred to use two-ply corrugated fiberboard, constituted of either one B- and one C-flute or a double C-flute arrangement. As used herein, one ply is defined as a single sheet of double-wall corrugated fiberboard. One flute corresponds to one corrugation. A-flutes are the largest in height and width, relative to B- and C-flutes. B-flutes are narrower and thinner than both A-flutes and C-flutes. Since B-flutes are denser than C-flutes, B-flutes tend to be heavier than C-flutes. Also C-flutes tend to be heavier than A-flutes.

The plies of a sheet of double-wall corrugated cardboard can be configurations of one B-flute and one C-flute, double C-flute, double A-flute or one A-flute and one C-flute. Of course, other combinations can be used as desired. Also, a triple-wall sheet may be substituted for the double-wall sheet, in which case, a configuration of three A-flutes or two A-flutes and one C-flute can be used. Of course, other combinations, including B-flutes, can be used as desired.

Attached to and extending from the lower planar surface of top member 110 are suitable structural supports or runners 120. A plurality of longitudinally extending multiple-ply corrugated fiberboard runners 120 are provided, each having an upper planar surface, a lower planar surface and end-plies 125. The upper planar surface of each of runners 120 is affixed to the lower planar surface of the top member 110. As shown, corrugations 127 of each of the runners 120 extend in the direction in which the corrugations 115 of the top member extend. Of course, runners 120 could be arranged so that the corrugations 127 extend in a direction transverse to the direction in which the corrugations 115 of the top member extend. In either case, these corrugations 125 of the runners 120 are also orthogonal to the corrugations 115 of the top member 110, in a preferred embodiment.

In the first embodiment, it is also preferred to use four runners 120 to support the top member 110. However, as will be discussed below, other configurations are envisioned. Therefore, the present invention is not limited to the use of four runners.

The arrangement of the runners 120 has been chosen to handle the stress presented by a load of boxes, goods or material of varying size so that weight is distributed evenly over the pallet 100 in a unitized load. Basically, the pallet 100 has no weight limitations, other than the capacity of the forklift or lift truck, since it is capable of withstanding large loads and is itself light in weight.

Attached to and extending from each of the runners 120 are a plurality of homogeneous, multiple-ply corrugated fiberboard structural supports 130 arranged in a grid array. Each of the supports 130 has an upper planar surface, a lower planar surface and end-plies 135. The upper planar surface of each of the supports 130 is affixed to the lower surface of a respective one of the runners 120. In the first embodiment, corrugations 137 of each of the supports 130 extend in a direction transverse to the direction of the corrugations 115 of the top member 110. Of course, the supports 130 can be arranged so that corrugations 137 extend in the same direction as the corrugations 115 of the top member 110. FIG. 1 shows that these corrugations 135 are also orthogonal to the corrugations 115 of the top member 110.

The runners 120 and supports 130 are suitably spaced on pallet 100 to accommodate therebetween the forks of a forklift from all four sides or a pallet jack from two sides. The spaced arrangement of the runners 120 and supports 130 is such that openings or windows 150 and 160 are presented of generally rectangular configuration, through which openings the forks of the lift truck or pallet jack may pass for lifting the pallet 100. With four-way entry provided, fork blades need not be adjusted for lifting from any direction.

A plurality of longitudinally extending multiple-ply corrugated fiberboard rails 140 are provided, each having an upper planar surface, a lower planar surface and end-plies 145. The upper planar surface of each of the rails 140 is affixed to a respective grouping of the supports 130. As with the corrugations 137 of the supports 130, corrugations 147 of the rails 140 extend in the direction transverse to the direction of the corrugations 115 of the top member. Of course, the rails 140 can be arranged such that corrugations 147 extend in the same direction as the corrugations 115 of the top member. Also, as with the corrugations 137 of the supports 130, the corrugations 147 of rails 140 extend orthogonally to the corrugations 115 of the top member.

Rails 140 serve to elevate pallet 100. Such elevation is useful to keep loads on pallet 100 elevated from wet surfaces. Rails 140 then act as a suitable buffer between the floor of a warehouse or a loading dock, for example, which may be damp or wet. Thus, the goods or items being carried by the pallet 100 are protected from such adverse ambient conditions. Further, rails 140 are useful in beam racking of the pallets 100, which occurs when floor space is limited.

In the preferred embodiment, each of the runners 120, supports 130 and rails 140 are made from either ten plies of double C-flutes or eleven plies of double B-C-flute corrugated fiberboard. Of course, other ply and flute arrangements can be utilized as strength and weight criteria dictate. For instance, six plies of triple-wall corrugated cardboard may be used in any of the A-, B- and C-flute combinations discussed above. However, we have found that these preferred arrangements provide optimum balance between strength and weight. In fact, such arrangements make the pallet of the present invention exceptionally strong in compression, relative to other pallet configurations. In particular, certain designs of the pallet 100 of the present invention can withstand loads up to 30,000 lbs! The pallet of the present invention also shows significant strength in shear, and withstands side-shifting.

In the preferred embodiment, the upper planar surface of each of the runners 120 is affixed to the lower planar surface of the top member 110, the upper planar surface of each of the supports 130 is affixed to the lower planar surface of respective ones of the runners 120 and the upper planar surface of each of the rails 140 is affixed to a lower surface of a respective grouping of the supports 130. Preferably, this affixing is performed by suitable adhesive or glue (not shown). For ease of manufacture, as well as for recyclability, this adhesive should be of a waterbase type. By way of example, it is preferred to use X3801 adhesive manufactured by H.B. Fuller Company. Other fastening means such as nails, staples and the like may be used. However, to reduce cost and for ease of recycling, it is desirable to use such adhesive, rather than other fastening means.

Figure 2:
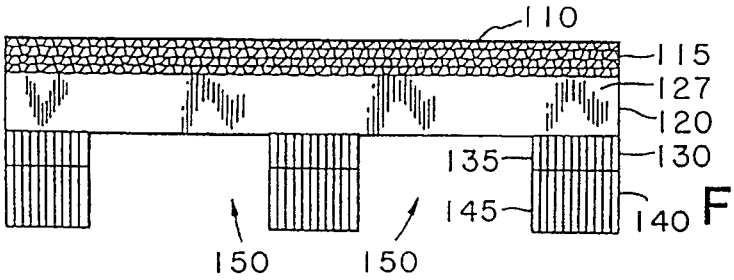
FIG. 2 is a front elevational view of the first embodiment.

FIG. 2 is a front elevational view of the pallet 100 of the first embodiment. FIG. 2 shows the corrugations 115 of top member 110. These corrugations 115 of top member 110 are also shown in partial cutaway form in FIG. 6. In FIG. 2, corrugations 127 of runners 120 extend in the direction in which the corrugations 115 of the top member 110 extend. The upper planar surface of each runner 120 is affixed by gluing, for instance, to the bottom planar surface of the top member 115. An upper planar surface each of the supports 130 is affixed to a lower planar surface of a respective one of runners 120. In this embodiment, corrugations 137 of the supports 130 extend in the same direction as those of the rails 140, as shown in FIG. 3.

In the preferred embodiment, three rails 140 are provided, each being affixed to a respective grouping of supports 130. The runners 120, supports 130 and rails 140 are arranged such that a product of the number of runners 120 and rails 140 equals the number of supports 130. An upper planar surface of each of rails 140 is affixed to a respective grouping of runners 130. Corrugations 137 of supports 130 and corrugations 147 of rails 140 extend in the same direction, in this embodiment. However, as discussed above, other arrangements are envisioned in the present invention. Corrugations 137 of supports 130 and corrugations 147 of rails 140 are also orthogonal to corrugations 115 of top member 110 to increase structural integrity.

Figure 3:
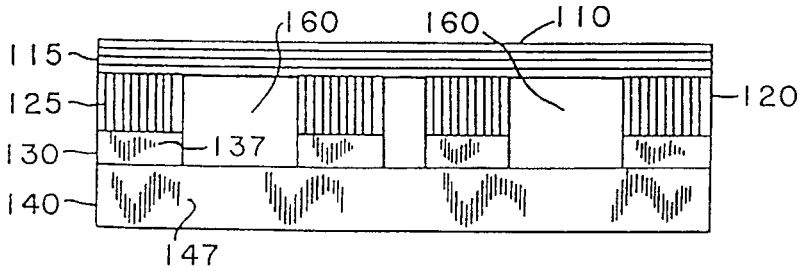
FIG. 3 is a side elevational view as seen from the right side of FIG. 1.

FIG. 2 further shows generally rectangular shaped openings or windows 150 while FIG. 3 depicts generally rectangular shaped openings or windows 160, which are generated by the configuration of the elements in pallet 100. Openings 150 and 160 allow both two-way and four-way entry of pallet handling devices such as lift trucks, pallet jacks and hand trucks. Specifically, four-way entry is provided for lift trucks, while two-way entry is provided for pallet jacks.

FIG. 3 is a side elevational view of the pallet 100 of the first embodiment. Primarily, FIG. 3 shows corrugations 137 of supports 130 and corrugations 147 of rails 140 extending in a direction transverse to corrugations 115 of top member 110. Corrugations 137 of supports 130 and corrugations 147 of rails 140 are also orthogonal to corrugations 115 of top member 110 to increase structural integrity.

Figure 4:
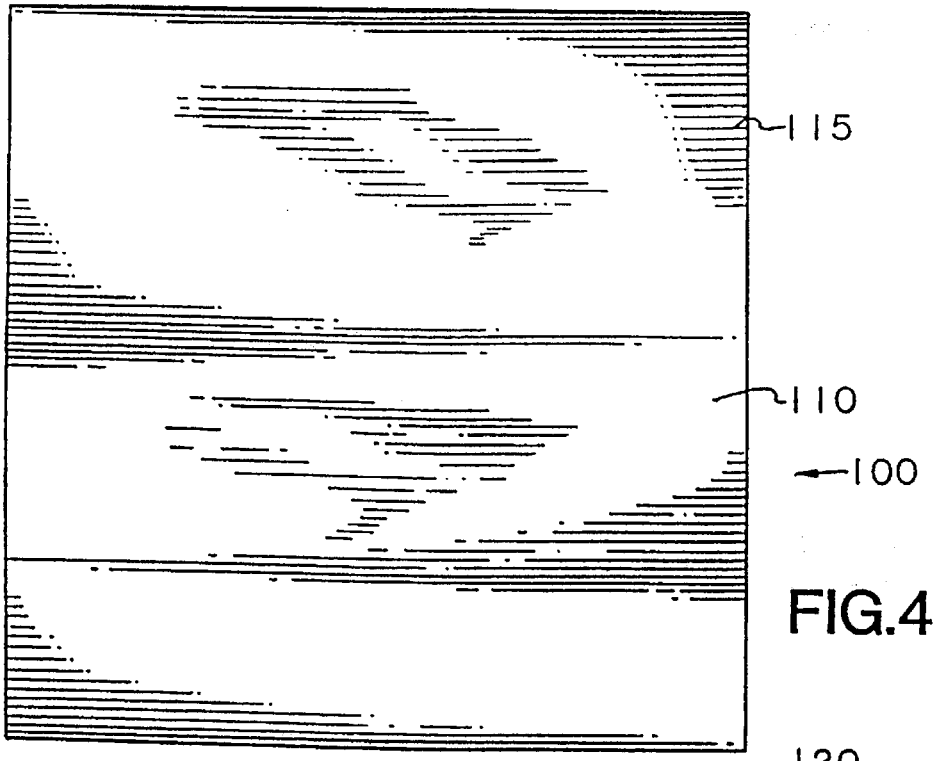
FIG. 4 is a top plan view of the first embodiment.

FIG. 4 is a top plan view of the pallet 100 of the first embodiment, showing the direction in which corrugations 115 of the top member 110 extend.

Figure 5:
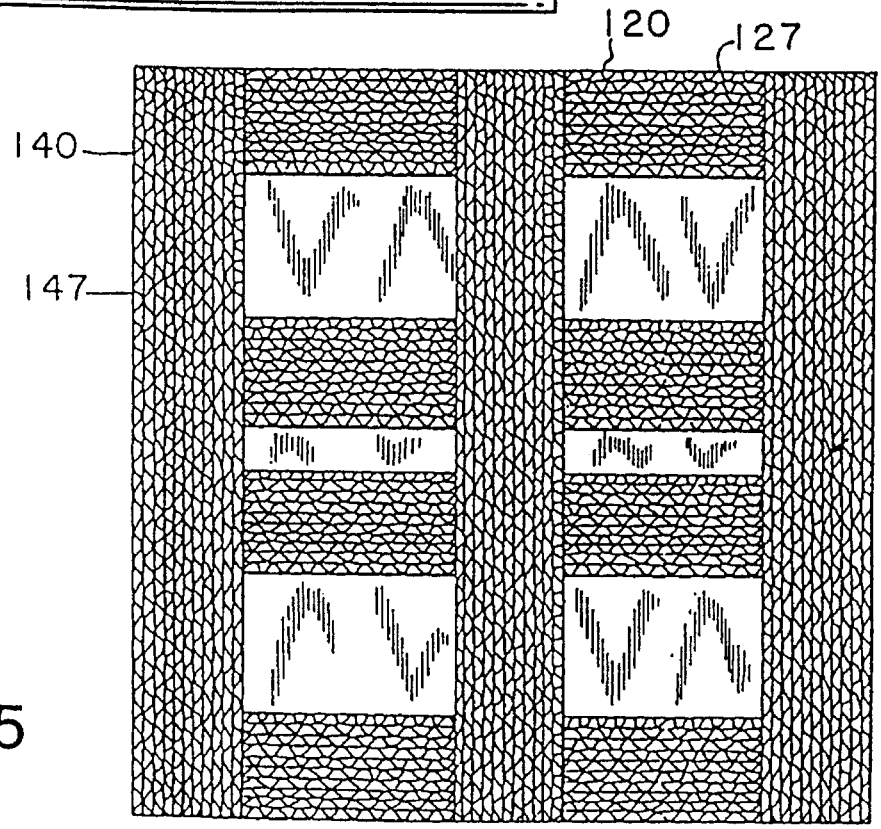
FIG. 5 is a bottom plan view of the first embodiment, looking up from beneath the pallet shown in FIG. 1.

FIG. 5 is a bottom plan view of the pallet 100 of the first embodiment, looking up from beneath the pallet shown in FIG. 1. FIG. 5 shows the arrangement of rails 140 and runners 120. Corrugations 147 of rails 140 extend in a direction transverse to the direction in which those of the top member 110 extend. Corrugations 127 of runners 120 extend in a direction transverse to the direction in which those of the rails 140 extend.

Figure 6:
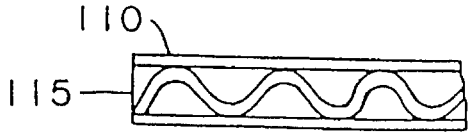
FIG. 6 is a partial cutaway elevational view showing a partial arrangement of corrugations of the top member of the first embodiment.

FIG. 6 shows a partial cutaway view showing a partial arrangement of corrugations 115 of top member 110.

FIGS. 7 through 11 depict a second embodiment of the corrugated fiberboard pallet of the present invention. Similar reference numerals in those figures have been used for like elements in the first embodiment.

Figure 7:
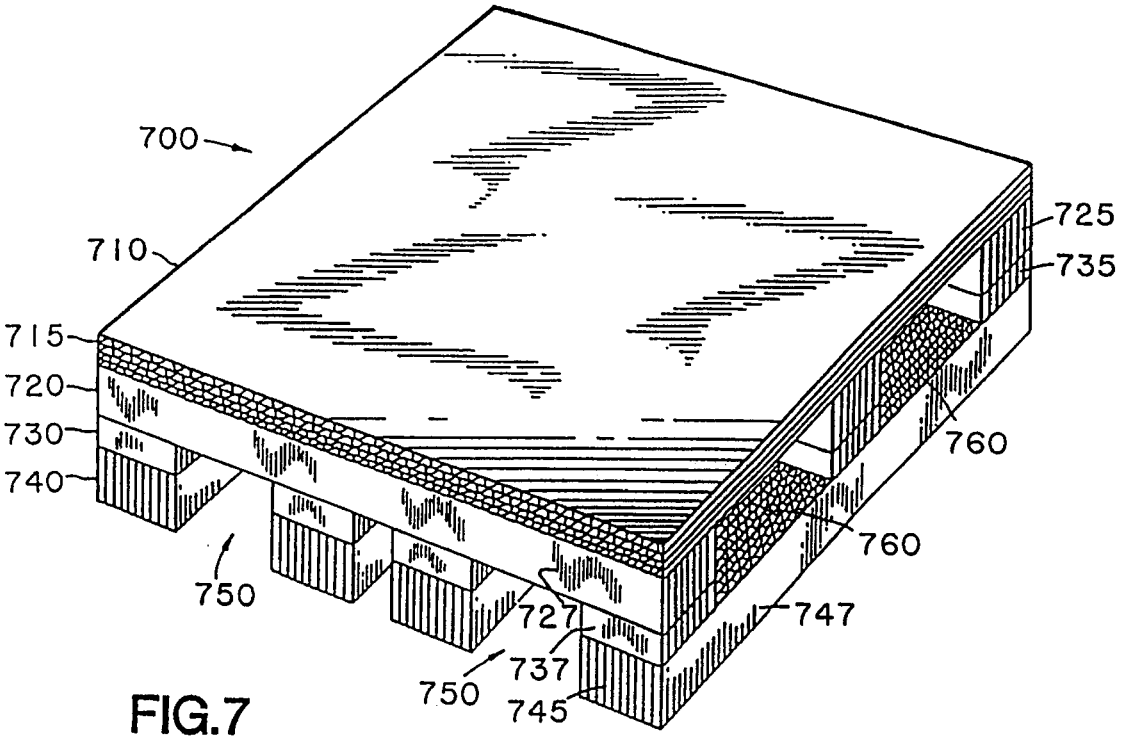
FIG. 7 is a perspective view of a second embodiment of a corrugated fiberboard pallet of the present invention.

FIG. 7 is a perspective view of a corrugated fiberboard pallet 700 in a second embodiment of the present invention. It will be noted that pallet 700 is essentially the same as pallet 100, only having top member 110 being affixed to the lower rails 140, rather than to the upper runners 120. That is, pallet 100 has been flipped over, with top member 110 then being affixed to the top of such a configuration in the manner discussed below.

In FIG. 7, pallet 700 has a multiple-ply corrugated fiberboard top member 710, having an upper planar surface and a lower planar surface. Corrugations 715 of the multiple-ply top member extend in a first direction. In the preferred embodiment, as in the first embodiment, top member 710 is two-ply corrugated fiberboard in a configuration of one B-flute and one C-flute, double C-flute, double A-flute, or one A-flute and one C-flute. While the preferred embodiments provide the most strength, other arrangements of A-, B- or C-flutes, alone or in combination, are envisioned.

A plurality of longitudinally extending multiple-ply corrugated fiberboard runners 720 are provided. Runners 720 each have an upper planar surface, a lower planar surface and end-plies 725. The upper planar surface of each of the runners 720 is affixed to the lower planar surface of the top member 710. As shown, corrugations 727 of each the runners 720 extend in the direction in which the corrugations 715 of the top member 710 extend. The corrugations 727 of the runners 720 are also orthogonal to the corrugations 715 of the top member 710.

A plurality of homogeneous multiple-ply, corrugated fiberboard supports 730 each have an upper planar surface a lower planar surface and end-plies 735. An upper planar surface of each of the supports 730 is affixed to the lower planar surface of respective ones of the runners 720. As shown, corrugations 737 of each of the supports 730 extend in the direction in which the corrugations 715 of the top member 710 extend. Corrugations 737 of the supports 730 are also orthogonal to the corrugations 715 of the top member 710.

A plurality of longitudinally extending multiple-ply corrugated fiberboard rails 740 each have an upper planar surface, a lower planar surface and end-plies 745. The upper planar surface of each of the rails 740 is affixed to a respective grouping of the supports 730. As shown, corrugations 747 of the rails 740 extend in a direction transverse to the direction that the corrugations 715 of the top member 710 extend. Corrugations 745 of the rails 740 are also orthogonal to the corrugations 715 of the top member 710.

Of course, in the manner discussed above with respect to the first embodiment, the runners 720, supports 730 and rails 740 can be arranged such that their respective corrugations extend either in the direction in which the corrugations 715 of the top member extend or in a direction transverse to that direction.

As in the first embodiment, respective elements of pallet 700 are affixed by gluing, for example. For instance, water-based glue such as X3801 manufactured by H.B. Fuller Company may be used.

Figure 8:
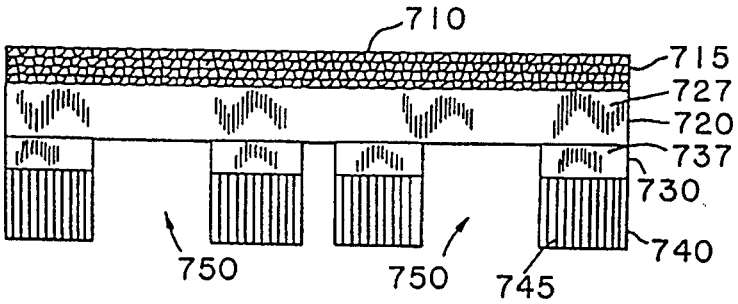
FIG. 8 is a front elevational view of the second embodiment.
Figure 9:
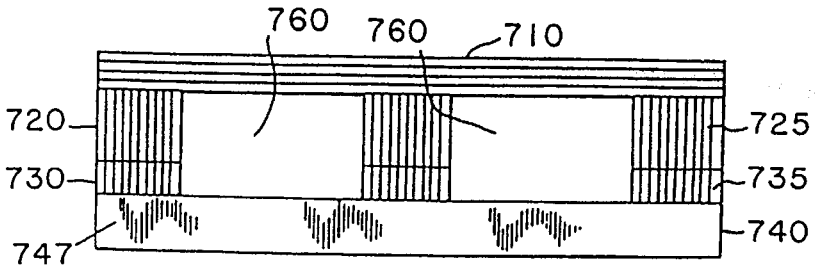
FIG. 9 is a side elevational view of the second embodiment as seen from the right side of FIG. 7.

FIG. 8 is a front elevational view of pallet 700 of the second embodiment. FIG. 9 is a side elevational view of pallet 700 of the second embodiment, as seen from the right side of FIG. 7. FIG. 8 shows generally rectangular shaped openings or windows 750, while FIG. 9 shows generally rectangular shaped openings or windows 760 which allow two-way and four-way entry of pallet moving devices such as hand trucks, pallet jacks and lift trucks, as discussed above with respect to FIG. 3.

Figure 10:
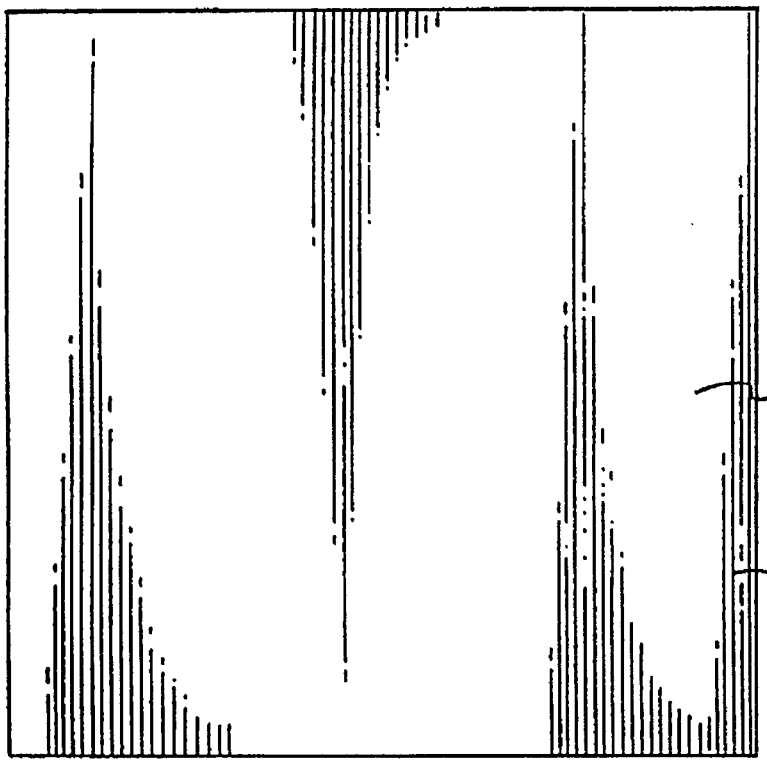
FIG. 10 is a top plan view of the second embodiment.

FIG. 10 is a top plan view of the pallet 700 of the second embodiment showing the direction in which corrugations 715 of the top member 710 extend.

Figure 11:
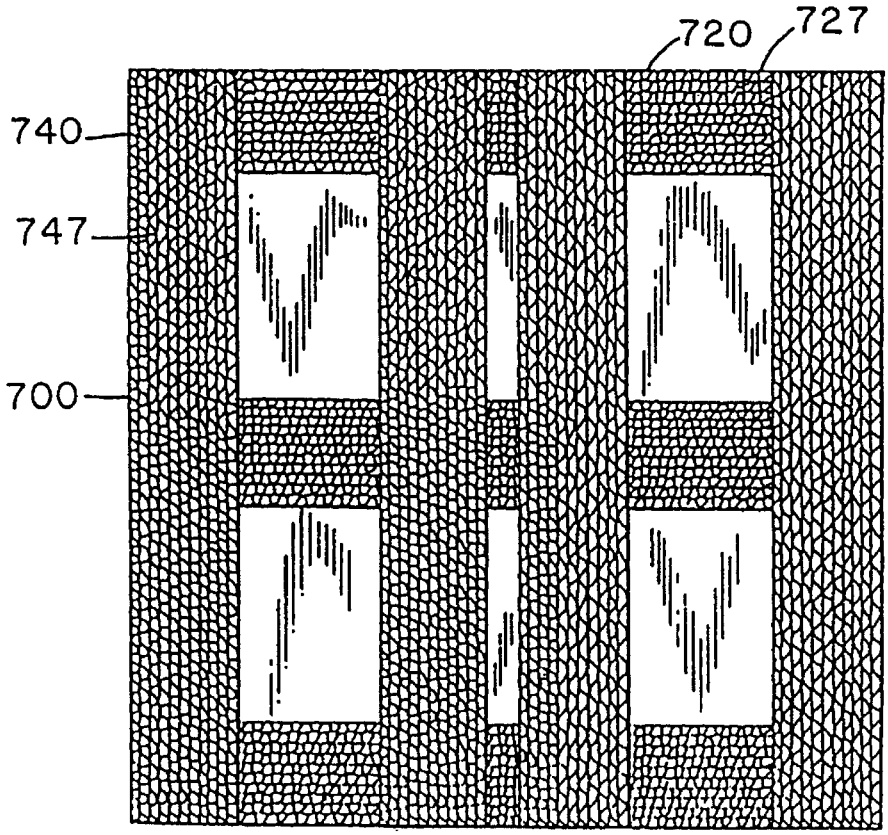
FIG. 11 is a bottom plan view of the second embodiment, looking up from beneath FIG. 7.

FIG. 11 is a bottom plan view of the pallet 700 of the second embodiment, looking up from beneath FIG. 7. FIG. 11 shows corrugations 747 of rails 740, which extend in the direction transverse to the direction that corrugations 715 of top member 710 extend. Corrugations 727 of runners 720 extend in a direction transverse to that direction. However, as discussed above, these directions can be rearranged, as desired.

As in the previous embodiment, it is preferred to use either ten plies of double C-flutes or eleven plies of either double B- or double C-flute corrugated fiberboard for each of runners 720, supports 730 and rails 740 of pallet 700 of the second embodiment. Of course, other configurations could be used as applications require. However, as discussed above, these preferred embodiments provide optimum balance between strength and weight.

As in the first embodiment, the number of the plurality of supports 730 equals the product of the number of plurality of runners 720 and the number of the plurality of the rails 740.

In each of the embodiments discussed above, each of the plurality of supports has a common dimension with a respective one of the plurality of runners and a respective one of the plurality of rails. Further, the height of each of the plurality of supports is substantially equal to the height of the top member, and the height of each of the plurality of runners and that of each of the plurality of rails is substantially equal to twice the height of the top member. Also, respective runners and rails extend an entire dimension of the pallet so that these respective members and the supports may be readily aligned during manufacturing.

FIGS. 12 through 17 depict a third embodiment of the corrugated fiberboard pallet of the present invention.

Figure 12:
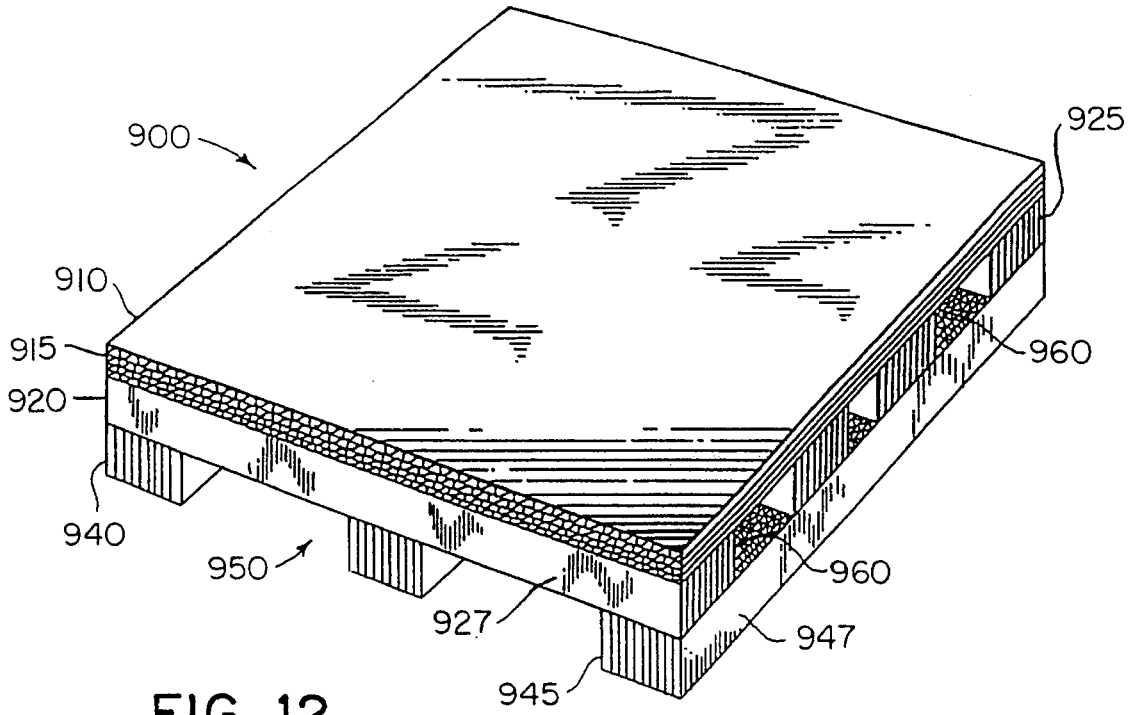
FIG. 12 is a perspective view of a third embodiment of a corrugated fiberboard pallet of the present invention.

FIG. 12 is a perspective view of a corrugated fiberboard pallet 900 in a third embodiment of the present invention. It will be noted that pallet 900 is similar to pallets 100 and 700, discussed above, except that pallet 900 utilizes no supports. Rather, runners 920 are affixed directly to rails 940, as will be discussed below.

In FIG. 12, pallet 900 has a multiple-ply corrugated fiberboard top member 910, having an upper planar surface and a lower planar surface. Corrugations 915 of the multiple-ply top member extend in a first direction. In the preferred embodiment, as in the previous embodiments, top member 910 is two-ply corrugated fiberboard in a configuration of one B-flute and one C-flute, double C-flute, double A-flute or one A-flute and one C-flute. While the preferred embodiments provide the most strength, other arrangements of A-, B- or C-flutes, alone or in combination, are envisioned.

A plurality of longitudinally extending multiple-ply corrugated fiberboard runners 920 are provided. Four runners 920 are shown. However, the present invention is not limited to the use of four runners. Runners 920 each have an upper planar surface, a lower planar surface and end-plies 925. The upper planar surface of each of the runners 920 is affixed to the lower planar surface of the top member 910. As shown, corrugations 927 of each of the runners 920 extend in the direction in which the corrugations 915 of the top member 910 extend. The corrugations 927 of the runners 920 are also orthogonal to the corrugations 915 of the top member 910.

A plurality of longitudinally extending multiple-ply corrugated fiberboard rails 940 each have an upper planar surface, a lower planar surface and end-plies 945. In a preferred embodiment, rails 940 and runners 920 are like elements. The upper planar surface of each of the rails 940 is affixed to respective ones of the runners 920. As shown, corrugations 947 of the rails 940 extend in a direction transverse to the direction in which the corrugations 915 of the top member 910 extend. Corrugations 947 of the rails 940 are also orthogonal to the corrugations 915 of the top member 910.

Of course, the runners 920 and rails 940 can be arranged such that their respective corrugations extend either in the direction in which the corrugations 915 of the top member extend or in a direction transverse to that direction.

As in the previous embodiments, respective elements of pallet 900 are affixed by gluing, for example.

Figure 13:
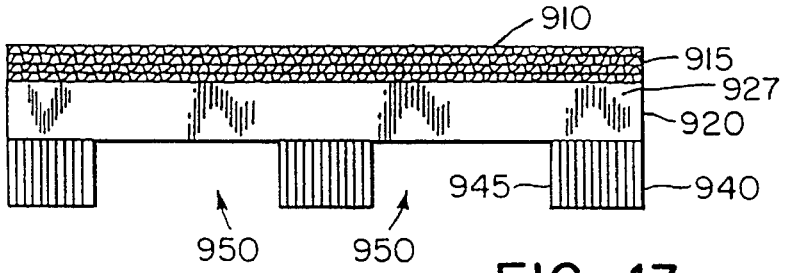
FIG. 13 is a front elevational view of the third embodiment.
Figure 14:
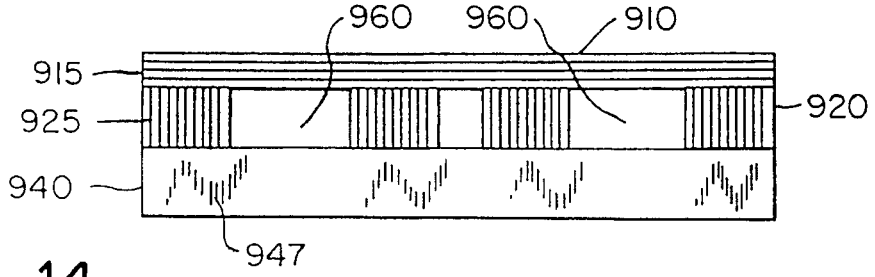
FIG. 14 is a side elevational view of the third embodiment as seen from the right side of FIG. 12.

FIG. 13 is a front elevational view of pallet 900 of the third embodiment. FIG. 14 is a side elevational view of pallet 900 of the third embodiment, as seen from the right side of FIG. 12. FIG. 13 shows generally rectangular shaped openings or windows 950, while FIG. 14 shows generally rectangular shaped openings or windows 960 that allow two-way and four-way entry of pallet moving devices such as hand trucks, pallet jacks and lift trucks, as discussed above.

Figure 15:
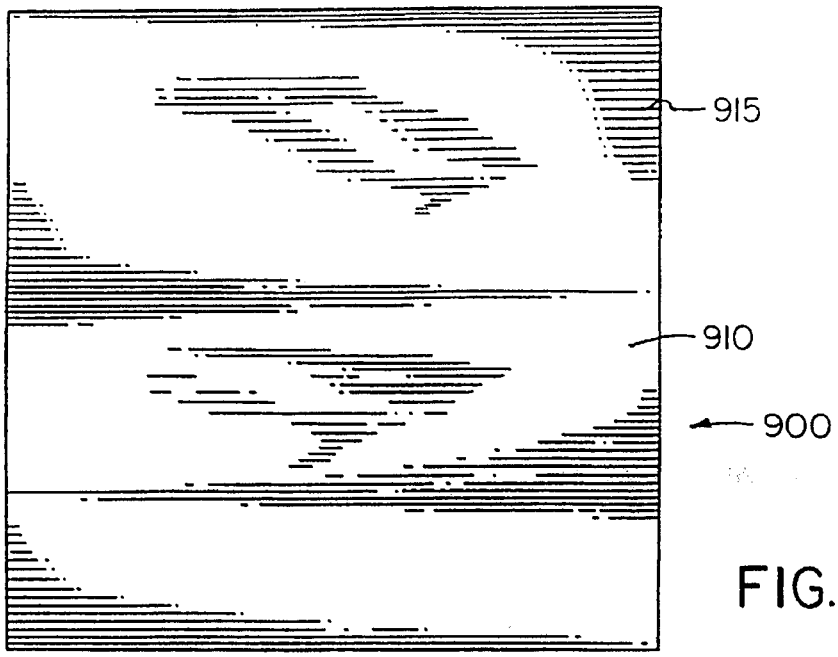
FIG. 15 is a top plan view of the third embodiment.

FIG. 15 is a top plan view of the pallet 900 of the third embodiment showing the direction in which corrugations 915 of the top member 910 extend.

Figure 16:
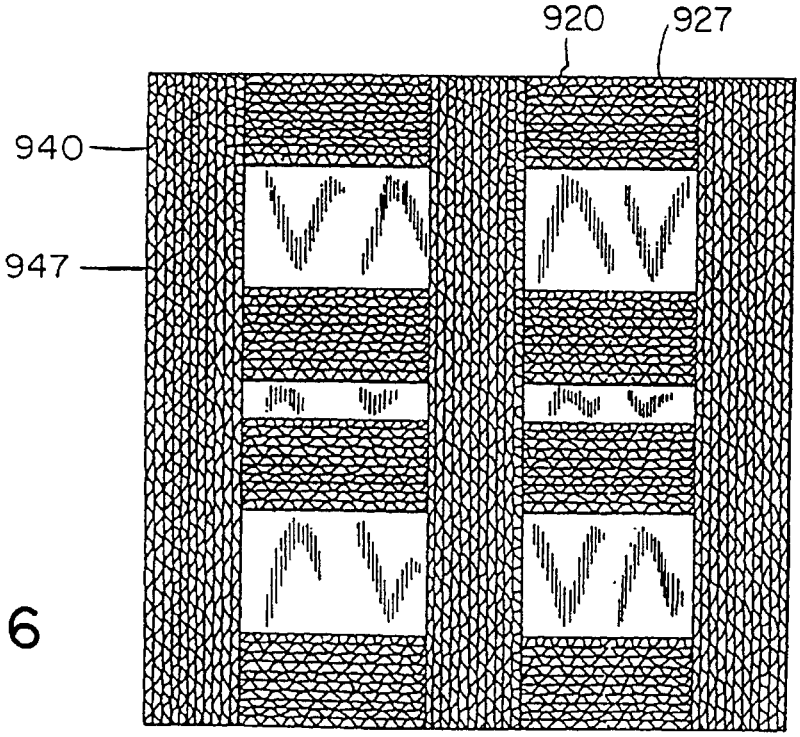
FIG. 16 is a bottom plan view of the third embodiment, looking up beneath the pallet shown in FIG. 12.

FIG. 16 is a bottom plan view of the pallet 900 of the second embodiment, looking up from beneath FIG. 12. FIG. 16 shows corrugations 947 of rails 940, which extend in the direction transverse to the direction in which corrugations 915 of top member 910 extend. As discussed above, as shown, corrugations 927 of runners 920 extend in the direction in which the corrugations 915 of the top member extend. However, as discussed above, these directions can be rearranged, as desired.

As in the previous embodiments, it is preferred to use either ten plies of double C-flutes or eleven plies of double B-C-flute corrugated fiberboard for each of runners 920 and rails 940 of pallet 900 of the third embodiment.

Of course, other configurations could be used as applications require. However, as discussed above, these preferred embodiments provide optimum balance between strength and weight.

Figure 17:
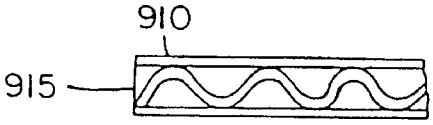
FIG. 17 is a partial cutaway elevational view showing a partial arrangement of corrugations of the top member of the third embodiment.

FIG. 17 shows a partial cutaway elevational view showing a partial arrangement of corrugations 915 of top member 910 of the third embodiment.

In the discussion above, many surfaces have been referred to as being "planar" (e.g., substantially flat). However, such surfaces can be configured in other ways. Therefore, the present invention is not limited to elements having planar surfaces.

If desired for additional strength or other reasons, a multiple-ply, corrugated bottom member (not shown) can be affixed to respective rails in any of the embodiments discussed above. Such a bottom member can be similar to the respective top members discussed above.

As discussed above, four runners have been shown in each of the embodiments. However, any number of runners, and rails for that matter, can be used, as circumstances warrant. Therefore, the present invention is not limited to the specific number of rails and runners shown.

For protection, pallet 100, pallet 700 and pallet 900 may be made water resistant by coating externally facing members with a water resistant material. For instance, a coating known as X-300 made by Michelman Company may be utilized. Of course, other similar water-resistant chemicals that are biodegradable and recyclable are known in the industry.

To assist in load-carrying, securing tabs (not shown) can be affixed to the runners or top members in the respective embodiments. Further, suitable wrapping (not shown) may be affixed to a respective top member of each of the pallets. A load may then be secured by shrinking wrap over a product load and securing to a respective top member. Thereby, a product load and a respective pallet become one unitized and self-contained unit. This safeguards against product-shifting in transporting or handling.

Thus, what has been described is a lightweight, easy to manufacture pallet capable of withstanding large loads, that, in application, is capable of presenting a unitized load. The present invention will find use in warehouses, stores, factories, vehicles or any place requiring a device to support or transport a load.

While the present invention has been described with respect to what is presently considered to be the preferred embodiments, the present invention is not limited to the disclosed embodiment. Rather, the present invention covers various modifications and equivalent arrangements included within the spirit and scope of the appended claims. The scope of the following claims is to be accorded the broadest interpretation so as to encompass all such modifications and equivalent structures and functions.

What is claimed is:

1. A corrugated fiberboard pallet, comprising:

a multiple-ply, corrugated fiberboard top member having an upper surface and a lower surface, corrugations of said multiple-ply top member extending in a first direction;

a plurality of multiple-ply corrugated fiberboard runners each having an upper surface and a lower surface, the upper surface of each of which being affixed to the lower surface of said top member and corrugations of each of which extending in one of the first direction and a direction transverse to the first direction;

a plurality of multiple-ply corrugated fiberboard supports each having an upper surface and a lower surface, the upper surface of each of which being affixed to the lower surface of respective ones of said runners and corrugations of each of which extending in one of the first direction and the direction transverse to the first direction; and a plurality of multiple-ply corrugated fiberboard rails each having an upper surface and a lower surface, the upper surface of each of which being affixed to a respective grouping of said supports and corrugations of each of which extending in one of the first direction and the direction transverse to the first direction.

2. The pallet according to claim 1, wherein each of said top member, said runners, said supports and said rails is made of a material selected from a group consisting of multiple-ply corrugated paperboard, cardboard and fiberboard.

3. The pallet according to claim 1, wherein each of said runners extends from end to end of said top supporting member.

4. The pallet according to claim 1, wherein said plurality of supports are arranged in a grid array, with spacing between each of said supports and an arrangement of said plurality of runners and rails allowing four-way entry of a transporting device.

5. The pallet according to claim 1, wherein respective elements of said pallet are affixed by gluing.

6. The pallet according to claim 1, wherein each of said plurality of runners and each of said plurality of rails are identical elements.

7. The pallet according to claim 1, wherein each of said plurality of supports has a common dimension with a respective one of said plurality of runners and a respective one of said plurality of rails.

8. The pallet according to claim 1, wherein externally facing members of said pallet are coated with a water resistant material.

9. The pallet according to claim 1, wherein corrugations of each of said runners, supports and rails extend orthogonal to the corrugations of said top member.

10. The pallet according to claim 1, wherein the corrugations of each of said rails extend transverse to the corrugations of each of said runners.

11. The pallet according to claim 1, further comprising a corrugated bottom member affixed to said rails.

* * * * *